US005957453A

United States Patent [19]

Binkley

[11] Patent Number: 5,957,453

[45] Date of Patent: Sep. 28, 1999

[54] SPIN PUZZLE USING MAGNETIC ELEMENTS

[76] Inventor: Dennis Binkley, 1546 Woodbine Way, Seattle, Wash. 98177-5339

[21] Appl. No.: 09/016,141

[22] Filed: Jan. 30, 1998

[51] Int. Cl.[6] ..... A63F 9/08

[52] U.S. Cl. ..... 273/153 S; 273/155

[58] Field of Search ..... 273/153, 153 S, 273/156, 157 R, 153 R; 446/117, 118, 120, 121, 124, 125

[56] References Cited

U.S. PATENT DOCUMENTS

| | | | |
|---|---|---|---|
| 3,091,361 | 5/1963 | Gawron | 446/117 |
| 3,717,942 | 2/1973 | Presby | 273/155 |
| 4,604,073 | 8/1986 | Livesey et al. | 446/117 |
| 4,651,992 | 3/1987 | Danino et al. | 273/155 |
| 4,752,074 | 6/1988 | Juang | 273/155 |
| 4,865,324 | 9/1989 | Nesis | 273/155 |
| 5,083,788 | 1/1992 | Conotter | 273/155 |
| 5,788,232 | 8/1998 | Binkley | 273/153 S |

FOREIGN PATENT DOCUMENTS

| | | | |
|---|---|---|---|
| 724131 | 2/1955 | United Kingdom | 273/155 |

*Primary Examiner*—Steven Wong
*Attorney, Agent, or Firm*—Jensen & Puntigam, P.S.

[57] ABSTRACT

The spin puzzle includes a plurality of individual spin elements having opposing spaced surfaces and a peripheral edge surface therebetween. Each element has a circular axial opening and a thin lip positioned about the axial opening on one surface of the spin element and extending away therefrom, the other opposing surface having a recess about the axial opening into which a lip from an adjacent element can fit so that the two elements abut in axial alignment. Also positioned on one opposing surface of each element are a plurality of spaced, raised rib portions, each rib portion being rounded, elongated and relatively narrow. In the other opposing surface are matching cavities into which the rib portions from an adjacent element can fit, thus providing a rotational indexing capability for each element.

7 Claims, 2 Drawing Sheets

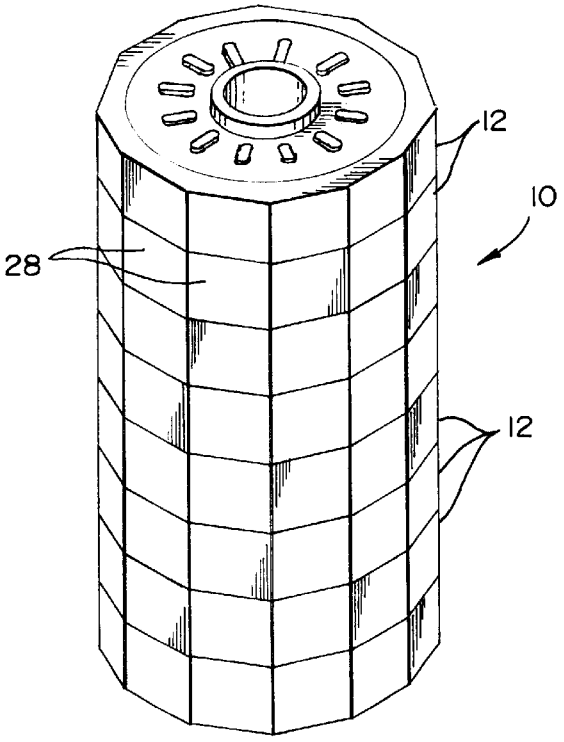
FIG. 1
FIG. 2
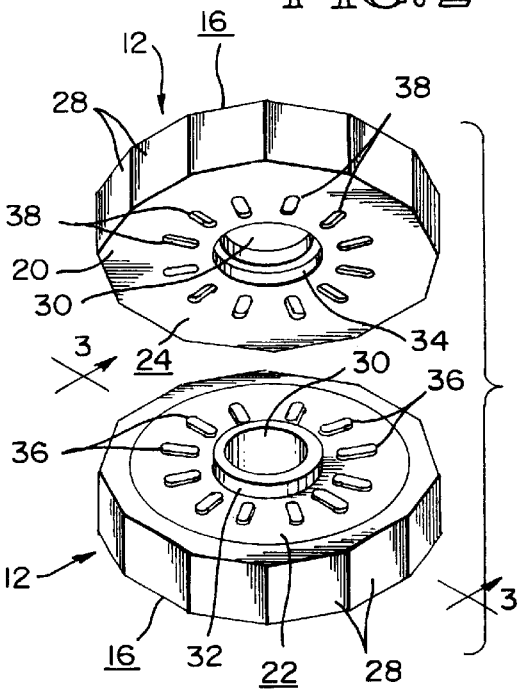
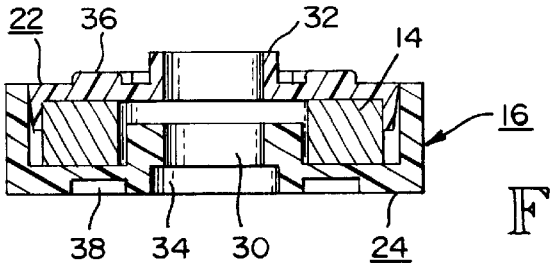
FIG. 3

SPIN PUZZLE USING MAGNETIC ELEMENTS

TECHNICAL FIELD

This invention relates generally to spin puzzles which include a plurality of individual elements in axial alignment, and more particularly concerns such a spin puzzle in which the individual elements are held together by magnetic attraction.

BACKGROUND OF THE INVENTION

U.S. Pat. No. 4,865,324 to Nesis shows a magnetic spin puzzle generally of the type which is the subject of the present invention. The spin puzzle in Nesis comprises a series of donut-shaped puzzle elements, with a magnetic member contained therein. Numbers or letters are arranged on the peripheral face of each puzzle element. Each of the puzzle elements are rotatable relative to each other by the cooperation between protuberances located on one face of an element with spaced cavities on an opposing face of an adjacent element, the cavities typically being situated in a circular groove in the same opposing face of the element. The puzzle elements are held together by magnetic attraction, while the axial alignment and rotary indexing of the elements are both accomplished by the protuberance/cavity arrangement, i.e. both axial alignment and rotary indexing are accomplished by the same physical structure on the puzzle elements.

In certain cases, however, it may be important to maintain a more positive axial alignment of the magnetic puzzle elements which is independent of the rotary indexing structure, while at the same time the magnetic capability maintains an attraction of adjacent elements.

DISCLOSURE OF THE INVENTION

Accordingly, the present invention is a spin puzzle which includes a plurality of spin elements, with each spin element having two opposing surfaces and an intermediate peripheral surface which has indicia therearound at spaced intervals, the spin elements having an axial opening therethrough and a magnetic member therein, such that opposing surfaces of adjacent elements are attracted to each other; wherein each spin element includes a lip about the axial opening on a first opposing surface, and further includes a recess about the axial opening in the second opposing surface such that a lip of one spin element fits into the recess of an adjacent element so as to maintain axial alignment of the two elements; and wherein each element further includes a plurality of spaced, raised rib portions on one of the opposing surfaces, the rib portions being spaced away from the axial opening, each element further including a plurality of cavities in the other opposing surface, into which rib portions from an adjacent element can readily fit, providing a rotating indexing capability of the elements relative to each other.

BRIEF DESCRIPTION OF THE DRAWINGS

FIG. 1 is a perspective view showing a complete spin puzzle of the present invention, comprising eight individual elements.

FIG. 2 is an exploded view of two adjacent elements of the present invention.

FIG. 3 is a cross-sectional view of one of the elements of FIG. 2.

BEST MODE FOR CARRYING OUT THE INVENTION

Figure 4:
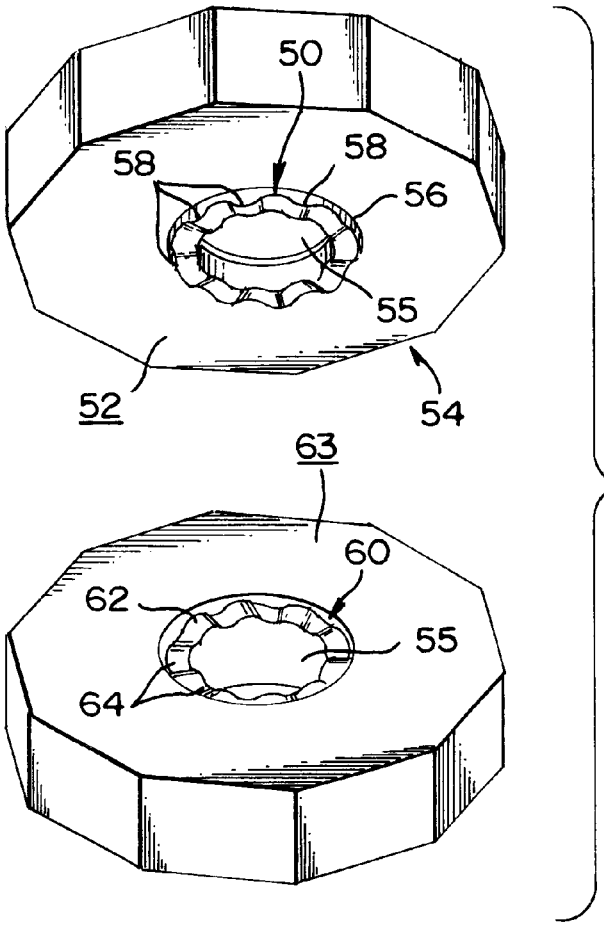
FIG. 4 is an exploded view of two adjacent elements of another embodiment of the spin puzzle elements.

FIG. 1 shows the spin puzzle of the present invention, shown generally at 10. Spin puzzle 10 comprises a plurality of individual donut-shaped puzzle elements 12—12. The number of puzzle elements can vary, although eight is a representative number. Each of the individual elements 12 includes a donut-shaped magnetic element 14 therein. The individual puzzle elements 12—12 are rotatable relative to each other. The exposed peripheral surface 16 of each puzzle element 12 has indicia such as numbers, letters or other representations, at spaced intervals therearound. With letters, for instance, the game is arranged so that selected words can be spelled out horizontally (axially) long the puzzle. In the embodiment shown, with 10 individual letters on the peripheral surface of each element, a total of 10 words appear axially, as the puzzle is rotated as a whole. The accomplish this result, each of the individual elements must be placed in both the correct linear and rotation position with respect to each other, thus solving the puzzle. Numbers and/or other symbols, including illustrations, can be used as well on the peripheral surfaces of the elements.

The present invention includes a particular arrangement for maintaining axial alignment of the puzzle elements which is separate from the structure for rotationally indexing the elements. FIGS. 2 and 3 show the puzzle element of the present invention. Element 12 comprises a plastic housing or shell 20 having opposing side surfaces 22 and 24 and an intermediate peripheral surface 16. The peripheral surface comprises ten flat surfaces 28—28, forming a complete circle, each one of which has an indicia thereon, although the peripheral surface could be continuously curved or have other outline configurations, such as triangular or square. Each of the elements 12 includes a central opening 30.

A lip 32 extends outwardly from one surface 22, about central opening 30. In the embodiment shown, lip 32 is approximately ⅛" high, although this could be varied somewhat. On opposing surface 24 of each element is a recess 34 about central opening 30. The depth of recess 34 is approximately equal to the height of lip 32 and has a similar configuration, so that as two elements are brought together, with surface 22 of one element coming into contact with opposing surface 24 of an adjacent element, lip 32 on said surface 22 fits into recess 34 in said opposing surface 24 of the adjacent element. The lip/recess arrangement is designed to maintain axial alignment of the adjacent elements. The magnetic attraction between the two elements, due to the magnetic members in the elements, maintains the two elements physically together, i.e. in contact with other, although the two elements may be readily separated by the user of the game.

Arranged on surface 22 of each element, separate from lip 32, are a series of elongated, rounded ribs 36—36. Ribs 36 extend slightly upwardly from surface 22. They are rounded at the edges to facilitate a free release of two adjacent elements and ease of rotation thereof. In the embodiment shown, the ribs are approximately ⅛" long by 1/16" wide and 1/16" high, with rounded edges. The height of ribs 36 is substantially less than the height of lip 32. In the embodiment shown, ribs 36 are arranged like spokes around central opening 30. In the embodiment shown, there are ten equally spaced individual ribs, with each rib being located between lip 32 and peripheral surface 16.

On opposing surface 24 of each puzzle element are a series of cavities 38 which are designed to receive rounded ribs 36 from an adjacent element so that when the ribs 36 are nested in cavities 38, surfaces 22 and 24 of the two adjacent elements abut together. The rib/cavity arrangement provides a click-stop rotational indexing capability of the puzzle. With ten indicia on the peripheral surface of each element and with 10 ribs/cavities on the opposing surfaces of each element, the elements can be rotated incrementally to a secure stop at each successive indicia.

In use of the puzzle, the two adjacent puzzle elements are rotated relative to each other. Typically, this action results in the two elements separating slightly axially, with ribs 36 of one element coming clear of the cavities in the adjacent element. The mating lip/recess structure of the two elements, however, will maintain the axial alignment of the two units unless the two elements are pulled apart sufficiently that the lip portion of one element entirely disengages from the recess in the other element, which will typically not be the case. The two elements are rotated until the new desired rotational relationship is reached, at which point the two elements are released so that they come to abut again by magnetic attraction, with the ribs again nesting into the cavities on the adjacent elements.

Hence, in the present invention, the magnetic member within each element maintains the attraction between the various elements, holding them together, while the lip/recess arrangement maintains axial alignment of adjacent elements, and the rib/cavity structure, with the rounded ribs, provides a rotational indexing capability in which the two elements "release" from one another sufficiently to permit continued rotation to an alignment with different faces thereof.

Figure 5:
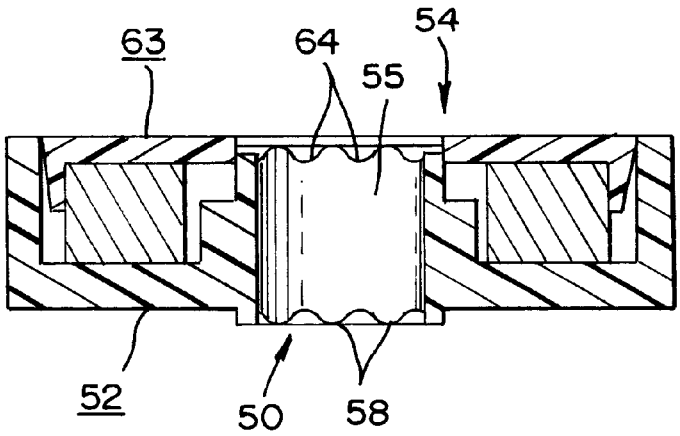
FIG. 5 is a cross-sectional view of one of the elements of FIG. 4.

FIGS. 4 and 5 show another puzzle element. Unlike the structure of FIGS. 2 and 3, lip element 50, which extends away from one surface 52 of each element 54, about central opening 55, includes a wavy or variegated upper edge 56 having a plurality of spaced rib portions 58—58. The recess 60 on the other surface 63 of element 54 about central opening 55 of the element includes a variegated or wavy lower edge 62, which includes a number of cavity portions 64—64 therein. The rib portions 58—58 on the upper edge of lip 50 mate with the cavity portions 64—64 in the lower edge of recess 60 to provide rotational indexing. In addition, the lip/recess structure provides axial alignment, while the magnetic members provide the physical attraction between adjacent elements.

Although a preferred embodiment of the invention has been disclosed herein for illustration, it should be understood that various changes, modifications and substitutions may be incorporated in such embodiment without departing from the spirit of the invention, which is defined by the claims as follows.

What is claimed is:

1. A spin puzzle, comprising:

a plurality of spin elements, each spin element having two opposing surfaces and an intermediate peripheral surface having indicia therearound, the spin elements having an axial opening therethrough and a magnetic member therein, such that opposing surfaces of adjacent elements are attracted to each other;

wherein each spin element includes a lip about the axial opening in a first opposing surface, said lip extending upwardly above said first opposing surface, and further includes a recess about the axial opening in the second opposing surface, said recess extending inwardly of the spin element from said second opposing surface, such that a lip of one spin element fits into the recess of an adjacent element so as to maintain axial alignment of the two elements; and wherein each element further includes a plurality of spaced, raised rib portions on one of the opposing surfaces, the rib portions being spaced away from the axial opening, each element further including a plurality of cavities in the other opposing surface, into which rib portions from an adjacent element can readily fit, providing a rotational indexing capability of the elements relative to each other, the rotational indexing capability being physically separate from and independent of the axial alignment capability of the elements.

2. An article of claim 1, wherein the rib portions have edges which are rounded, to facilitate easy release of one element relative to an adjacent element as said elements are rotated relative to each other.

3. An article of claim 1, wherein said lip is higher than said rib portions.

4. An article of claim 1, wherein the rib portions are equally spaced around the one opposing surface of each spin element and the cavities are equally spaced around the other surface of each spin element and wherein the number of cavities is equal to the number of desired stops for an element during one rotation thereof.

5. An article of claim 2, wherein the rib portions are elongated, narrow and oriented radially from the axial opening to the peripheral surface.

6. An article of claim 1, wherein each spin element is approximately circular in outline, and wherein the axial opening is also circular.

7. An article of claim 1, wherein the recess opens onto the axial opening.

* * * * *